US009708163B2

(12) United States Patent
Ojapalo

(10) Patent No.: US 9,708,163 B2
(45) Date of Patent: Jul. 18, 2017

(54) CRANE HAVING FRAME FORMED FROM SUBASSEMBLIES

(71) Applicant: KONECRANES GLOBAL CORPORATION, Hyvinkää (FI)

(72) Inventor: Esa Ojapalo, Riihimäki (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 14/901,227

(22) PCT Filed: Jun. 26, 2014

(86) PCT No.: PCT/FI2014/050525

§ 371 (c)(1),
(2) Date: Dec. 28, 2015

(87) PCT Pub. No.: WO2014/207314

PCT Pub. Date: Dec. 31, 2014

(65) Prior Publication Data

US 2016/0145080 A1 May 26, 2016

(30) Foreign Application Priority Data

Jun. 27, 2013 (FI) ..... 20135703

(51) Int. Cl.

| | |
|---|---|
| ***B66C 9/00*** | (2006.01) |
| ***B66C 9/04*** | (2006.01) |
| ***B66C 19/02*** | (2006.01) |
| ***B66C 19/00*** | (2006.01) |
| ***B66C 23/46*** | (2006.01) |

(52) U.S. Cl.
CPC ..... *B66C 9/00* (2013.01); *B66C 9/04* (2013.01); *B66C 19/007* (2013.01); *B66C 19/02* (2013.01); *B66C 23/46* (2013.01)

(58) Field of Classification Search
CPC ..... B66C 19/00; B66C 19/02; B66C 19/002; B66C 19/005; B66C 19/007
See application file for complete search history.

(56) References Cited

U.S. PATENT DOCUMENTS 3,792,779 A 2/1974 Brazell
4,240,354 A * 12/1980 Newman ..... B61D 15/02 105/72.2
4,279,347 A * 7/1981 Appleman ..... B66C 19/007 212/274

(Continued)

FOREIGN PATENT DOCUMENTS

CN 201068369 Y 6/2008
CN 201713228 U 1/2011

(Continued)

*Primary Examiner* — John Walters
*Assistant Examiner* — James Triggs
(74) *Attorney, Agent, or Firm* — Birch, Stewart, Kolasch & Birch, LLP

(57) ABSTRACT

A crane, particularly a rubber-wheel container crane includes a frame which has, on opposite sides of its lower part, main beam structures at both ends of which, i.e. in the lower corners of the crane, there are two successive rubber wheels or wheel arrangements through which the crane is supported by its moving carrier. These wheels are supported by the main beam structure rigidly and in an unsuspended manner.

9 Claims, 3 Drawing Sheets

(56) References Cited

U.S. PATENT DOCUMENTS

Figure 1:
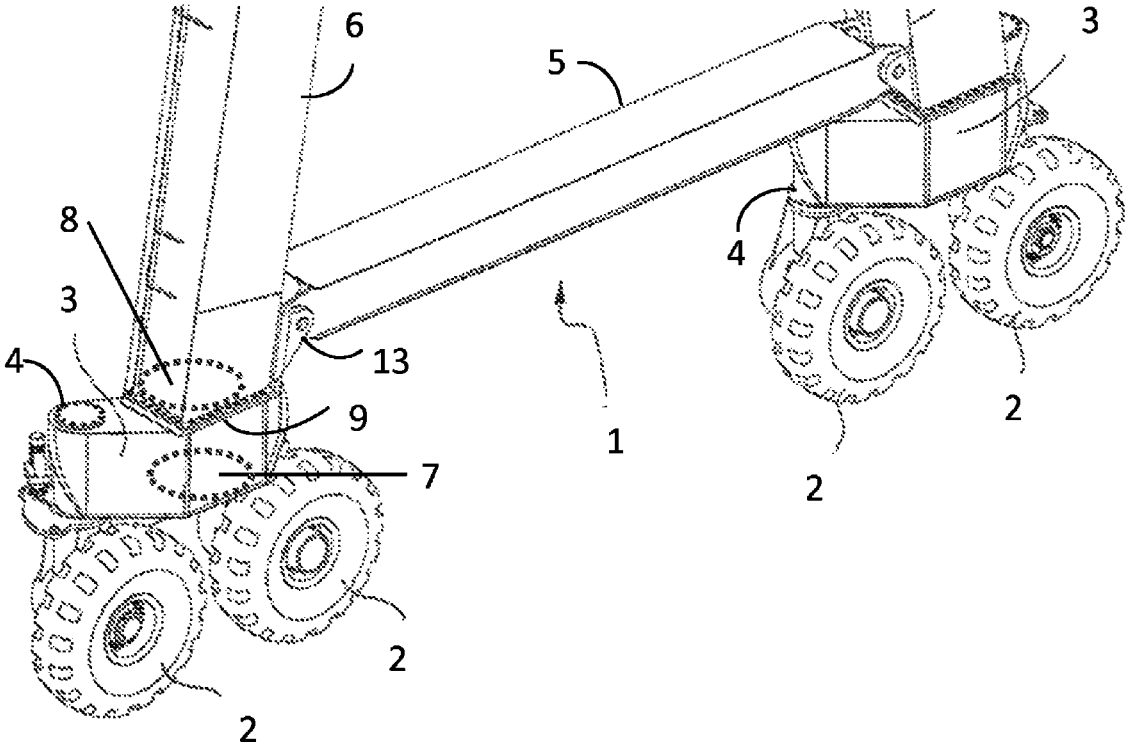

| | | | | | |
|---|---|---|---|---|---|
| 4,480,714 | A | * | 11/1984 | Yabuta | B60G 17/0195 180/290 |
| 4,880,124 | A | * | 11/1989 | Feider | B62D 7/09 180/252 |
| 2003/0108405 | A1 | | 6/2003 | Takehara et al. | |
| 2007/0108150 | A1 | | 5/2007 | Oja | |

FOREIGN PATENT DOCUMENTS

| | | | |
|---|---|---|---|
| CN | 202030451 | U | 11/2011 |
| CN | 202164044 | U | 3/2012 |
| CN | 202347441 | U | 7/2012 |
| DE | 35 42 190 | A1 | 6/1987 |
| EP | 1 506 888 | A1 | 2/2005 |
| FI | 117753 | B | 2/2007 |
| FR | 2 776 280 | A1 | 9/1999 |
| WO | WO 99/43534 | A1 | 9/1999 |

* cited by examiner

CRANE HAVING FRAME FORMED FROM SUBASSEMBLIES

BACKGROUND OF THE INVENTION

The invention relates to a crane, particularly a rubber-wheel container crane comprising a frame which has, on opposite sides of its lower part, main beam structures at both ends of which, i.e. in the lower corners of the crane, there are in each particular case two successive rubber wheels or wheel arrangements through which the crane is supported to its moving carrier.

The crane is thus supported to the carrier by means of wheels in the corners of the above-described structure. When the wheel load exceeds the load capacity limit of the wheel, more than one wheel per corner is required, whereby the corner load is divided between two or more wheels, and to divide the wheel load equally, an articulated balancing scale is typically constructed between them. In addition, in machines of a straddle carrier type, the wheels are suspended, and in some cases active springs have also been used.

This design originates from a crane moving on considerably uneven terrain. When one drives a crane with rubber wheels on relatively even terrain, such as in harbour yards, this structure is unduly complex and expensive, having thus also a great deal to be maintained and a large number of parts that wear. In some cases, maintenance of the scale articulation has been necessary as early as after one year of productive operation. Maintenance may take several days, and the crane may be out of productive operation for more than a week in total.

SUMMARY OF THE INVENTION

An object of the invention is to develop the crane mentioned at the beginning such that the structure would be optimized to better correspond to the requirements of its object of use, and that the costs caused by the crane could be, at the same time, essentially reduced. This object is achieved by a crane characterized in that the wheels in each corner of the crane are, in each particular case, supported to the main beam structure rigidly and in an unsuspended manner. Preferred embodiments of the invention are disclosed in the dependent claims.

The invention is based on the idea of utilizing the springing characteristics of rubber wheels, whereby the balancing scale and additional suspension used previously are no longer needed. In this way, the structure can be made simpler. Leaving out the balancing scale allows the rigidity of the crane frame structure and the natural elasticity of the rubber wheels to be utilized under a load, whereby minor unevenness of the terrain is evened out by this characteristic. Minor variations between the wheel loads in the corners can be allowed when taken into account in the structural analysis. The crane frame has the same function as it has when provided with a scale.

The invention also eliminates maintenance related to loosening of the articulation pin of the scale, previously required at regular intervals. When in harbour, the crane according to the invention is more stable under the influence of wind loads or waves. The base of the supports against the ground, i.e. the distance between the outer wheels, is greater in the driving direction when the articulation has been replaced with a rigid joint. Further, tying the crane to the ground or supporting it against storm is required more seldom for instance in time periods of five years. When the crane is driven forward/backward in a case of collision, the prior art articulation structure has allowed the frame to yield forward/backward, i.e. has exposed the frame to this, whereby with regard to stability, the crane has been more prone to fall forward/backward.

LIST OF FIGURES

Figure 2:
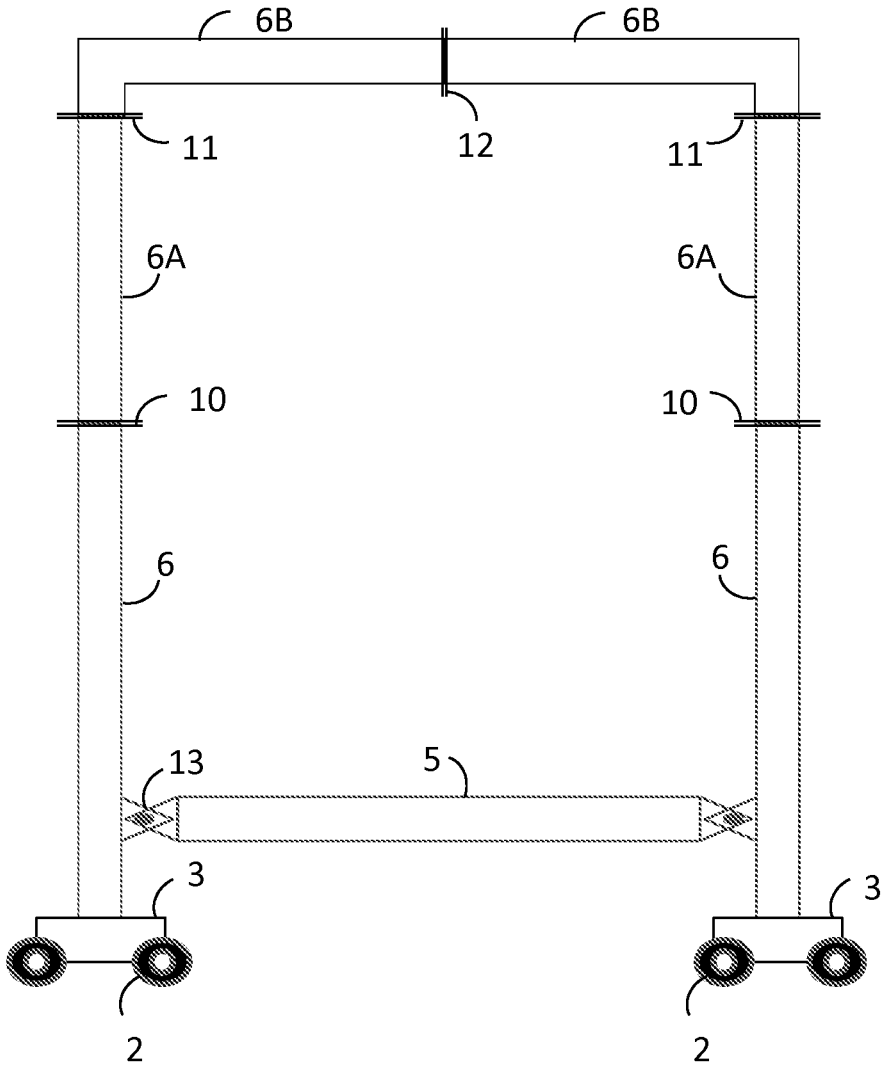
Figure 3:
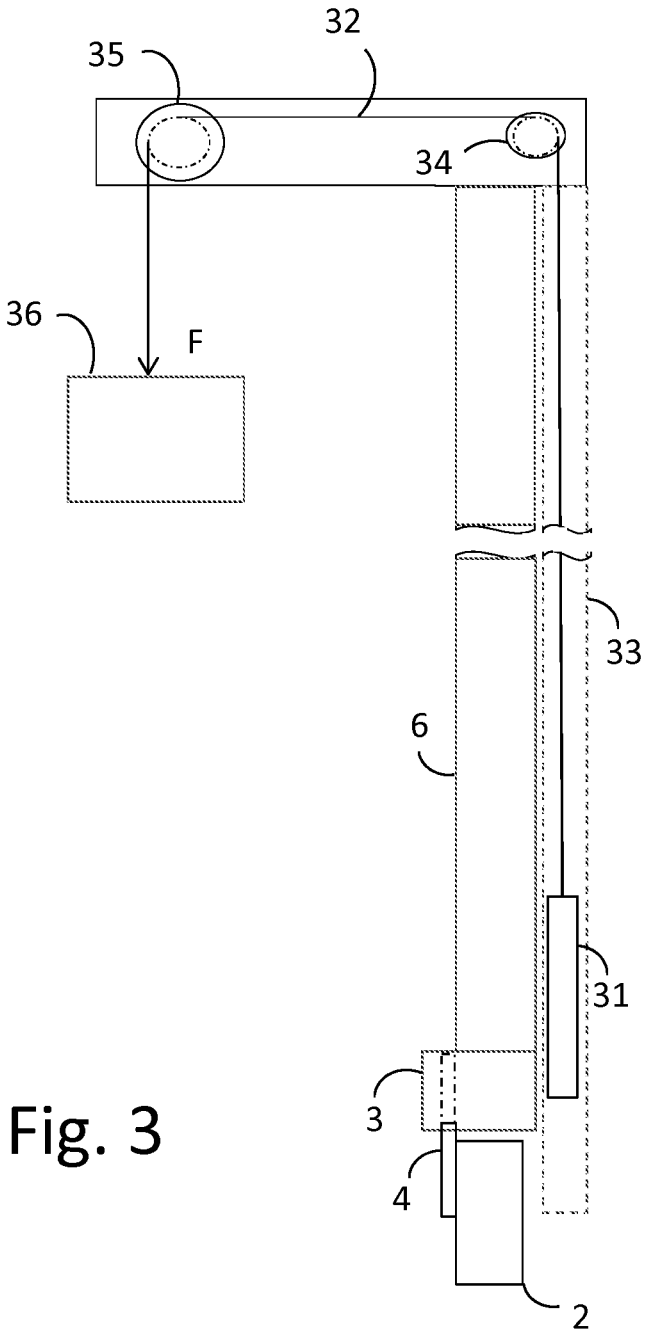

The invention will now be described in greater detail by means of one preferred exemplary embodiment and with reference to the attached drawing, in which FIG. 1 shows a main beam structure of the lower part of a crane frame with rubber wheels suspended to it;

FIG. 2 shows joint surfaces of the frame seen from the side of a structure of one structure type; and FIG. 3 shows guiding a counterweight on the side of a leg beam and an auxiliary frame from the front of the crane.

DETAILED DESCRIPTION OF THE INVENTION

With reference to the drawing, the crane according to the invention, particularly a rubber-wheel container crane, comprises a frame having, on opposite sides of its lower part, main beam structures 1, of which (and thus of the whole frame) only one is shown in the drawing as the structure on the other side of the crane frame is identical with it. At both ends of these frame structures 1, i.e. in the lower corners of the crane, there is in each particular case at least two successive rubber wheels 2 or wheel arrangements (possibly twin wheels, for example), through which the crane is supported to its moving carrier. What is essential is that these wheels 2 in each corner of the crane are, in each particular case, supported to the main beam structure 1 rigidly and in an unsuspended manner.

Preferably, these two successive wheels 2 (or wheel arrangements) are, in each particular case, rigidly supported to the main beam structure 1 by means of a rigid auxiliary frame 3. The auxiliary frame 3 is like a simplified "bogie" without any possibility for movement relative to the frame. It is also feasible to support the wheels 2 directly to the main beam structure 1. A horizontal beam 5 may be connected between the leg beams 6 by means of links 13, as shown by FIG. 1. In such a structure, the upper portion of the crane is typically made with rigid structures, such as bolt joints. Another alternative is to implement the joint in the lower part of the frame as a rigid joint, whereby the upper structure of the crane is typically implemented in some way elastically, for example by means of articulations.

The wheels 2 are supported to the main beam structures in such a way that they rotate substantially 90° around their vertical support axles 4. These support axles 4 and their rotatability may be implemented for instance as in FI patent 117753.

When conventional static dimensioning is used in the crane, all wheels 2 are arranged at the same level, but when dynamic dimensioning is used, the outermost wheels 2 of the wheels 2 arranged successively may be arranged to be lifted higher relative to the level of movement than the inner wheels 2, whereby the unevenness or obstacles on the route of the crane can be encountered more elastically and in a more balanced manner. In each pair of wheels in the crane, i.e. under each corner, there may be a drive wheel 2 and a freely rotating wheel 2 in a pair. One way to arrange the operation of the wheels 2 is to mount the drive wheel as the inner wheel and the free wheel as the outer wheel. This brings about the advantage that the outermost wheel receives possible impacts, and repairing is simpler as the wheel structure is simpler. Correspondingly, if the height of the outer wheel is to be changed in a controlled manner, the height-moving mechanism can be more easily arranged in the freely rotating wheel 2. The drive wheel and the freely rotating wheel 2 may, if desired, also be arranged in a mutually reversed order with regard to the successive corners (of the same side) in the frame structure 1.

Further, the wheel loads of the wheels 2 can be divided in a desired manner. This may be exploited by designing the bearing of the wheels 2 in such a way that the wheel loads are taken into account. The bearing of the freely rotating wheels 2 can be implemented in such a way, for example, that they carry a heavier load, and the bearing selected is one for a larger load than the bearing of the inner wheel 2, for example for reasons related to space utilization in a case where the axle of the inner wheel is the driving axle.

Preferably, in this example, the main beam structures 1 form in each particular case an A-shaped beam structure as seen from the side. The main beam structures 1 may also be at right angles, in which case the leg beam 6 extends substantially vertically from the auxiliary frame 3. Instead of being A-shaped, the side profile of the main beam structure 1 may be another kind of profile, for example in the shape of an inverted U (for instance when the lower horizontal beam 5 has been left out).

The auxiliary frame 3 may be easily openable from bolt joints of the frame structure 1, whereby during maintenance the entire wheel pair with its auxiliary frame 3 can be replaced with a spare part if required.

The main beams 5 and 6 of the crane may utilize closed profiles, open profiles and also combinations of these. In this way, possible elasticity of the frame can be utilized and, if desired, the elasticity of the frame can be tailored for each client and with respect to the evenness and the maintainability of evenness of the client's harbour yard (snow, ice, sand heap, damages by frost or grooves in the coating of the carrier).

All frame joints are preferably divided in such a way that all main beams are subassemblies, i.e. preferably the whole crane can be supplied in container transportation. Containers used in sea transportation include, for example, 20-foot and 40-foot containers and, in addition to these, there are also containers which are used more rarely but are larger. This is illustrated by means of an example in FIG. 2. The leg beam 6 of the crane may be implemented in such a way that it continues upward from the auxiliary frame 3 and ends at its upper end in a bolted and flanged joint 10 by means of which the leg beam 6 (beams) are connectable to the upper structures of the crane (e.g. leg beam 6A and horizontal beam 6B). Thus, the portion of the leg beam 6 below the flanged joint 10 may be for instance ⅗ of the crane height, and the height remaining for the structure above the flanged joint 10 (e.g. leg beam 6A and horizontal beam 6B) is ⅖ of the crane height. The flanged joint 10 having been detached for transportation, the portion below the flanged joint 10 can be pushed in from the end of the transportation container by means of the relatively long leg beam 6 and the wheels 2 already mounted on it. This crane subassembly (parts 3 and 6) may be carried by wheels 2 at one end, while the other end of the leg beam 6 may be, during transportation, carried by temporary transportation wheels (not shown in the figures) attached to the flange 10, for example. Further, the wheels 2 may be rotated 90 degrees around the support axles 4, in which case they are side by side and pushing them into the transportation container is stable. Correspondingly, the upper structure of the crane consists, according to the same principle, of subassemblies (e.g. parts 6A and 6B separately or in appropriate combinations) which can be transported inside a container when their main dimensions are smaller than the inner dimensions of the container. These subassemblies may be connected to one another with corresponding flanged joints 11 and 12.

In some embodiments, a counterweight 31 synchronized with the hoisting movements of a burden 36 (which is subjected to a hoisting force F) is arrangeable in a vertical guide or gap 33 on the outer or inner side of the leg beam 6, as illustrated in the example of FIG. 3. The counterweight 31 is typically connected to a hoisting mechanism 35 in the crane via a rope or ropes or the like means 32 and a rope pulley or rope pulleys 34 or the like. The hoisting mechanism 35 may be positioned up or down in the crane. The positioning or implementation of the hoisting mechanism 35 has no relevance. In accordance with embodiments of the invention, since the wheels 2 are supported rigidly to the main beam structure 1 by means of the auxiliary frame 3 without a scale articulation, the counterweight 31 is able to pass the rigid joint of the auxiliary frame 3 and main beam structure 1 and get lower than before, whereby the effective distance of vertical potential energy can be made greater. The height of the auxiliary frame 3 may be on the order of 800 mm, for example, which additional height can be utilized for guiding the counterweight 31 in the guide 33 reserved for it. Further, the diameter of the wheel 2 is on the order of 1.5 to 1.8 m, with regard to which for instance half of the diameter of the wheel 2 can be utilized and the added height benefit further increases. The example of FIG. 3 illustrates how the guide 33 and thus also the area of movement of the counterweight 31 extend to the level of the middle hub of the wheel 2.

Since the wheels 2 are supported to the main beam structure 1 by means of the rigid auxiliary frame 3 without a scale articulation, the cabling can be implemented in its entirety in such a way that it follows the steel structure. In the example of FIG. 1, this cabling at the height of the auxiliary frame 3 can be implemented in the simplest way without the possibility for cable elasticity that would be required by a scale articulation. In addition, the working platforms can be made continuous over the rigid joint (the eliminated scale articulation), whereby, for example, there is no risk that the worker's feet would get cut between the edges of reciprocally moving working platforms. The working platform (not shown in FIG. 1) may thus continue uniformly from the side of the leg beam 6 to the side of the auxiliary frame 3.

When the auxiliary frame 3 is directly connected to the leg beam 6 without articulation, such as at junction 9, an access hole 8 can be made between them on the inside of the steel structure. Thus, for example, a maintenance man can go through a service hatch 7 positioned under the auxiliary frame 3 upwards inside the leg beam 6 to the inner parts of the frame structure. This becomes possible when each flanged joint 10 and 11 in the frame has an access hole 8. The maintenance man can check the bolt joints from the inside, and check the structure with regard to corrosion and the condition of the welded joints.

The above description of the invention is only intended to illustrate the basic idea of the invention. A person skilled in the art may thus vary its details within the scope of the attached claims.

The invention claimed is:

1. A crane, comprising:

a frame comprising main beam structures;

wheels at lower ends of each of the main beam structures through which the crane is supported by a moving carrier thereof, wherein the wheels are supported by the main beam structures rigidly and in an unsuspended manner, wherein each of the main beam structures of the crane comprises several subassemblies attached to each other with detachable frame joints, wherein the wheels are connected to the main beam structures by a rigid auxiliary frame, and wherein the wheels may be rotated substantially 90 degrees around vertical support axles thereof.

2. The crane according to claim 1, wherein at least two wheels are supported by each of the main beam structures.

3. The crane according to claim 1, wherein the wheels include inner wheels and outermost wheels, and wherein the inner wheels are drive wheels.

4. The crane according to claim 1, wherein the wheels include inner wheels and outermost wheels, and wherein the load-carrying capacity of the outermost wheels is greater than the load-carrying capacity of the inner wheels.

5. The crane according to claim 1, wherein the main beam structures form a beam structure in the shape of an A or an inverted U as seen from the side.

6. The crane according to claim 1, wherein at least one of the subassemblies comprises a lower part of a leg beam of the frame, wherein the wheels are supported by the leg beam of the frame rigidly and in an unsuspended manner, and wherein an upper end of the leg beam has a detachable frame joint to attach the leg beam to an upper part of the frame structure for operation and to detach the leg beam for transportation.

7. A rubber-wheel container crane comprising:

a frame comprising main beam structures;

wheels at lower parts of the main beam structures through which the crane is supported by a moving carrier thereof, wherein the wheels are supported by the main beam structure rigidly and in an unsuspended manner, wherein each of the main beam structures of the crane comprises several subassemblies attached to each other with detachable flanged joints, wherein the wheels are connected to the main beam structures by a rigid auxiliary frame, and wherein the wheels may be rotated substantially 90 degrees around vertical support axles thereof.

8. The crane according to claim 1, wherein the distances between the frame joints determine main dimensions of the subassemblies, the main dimensions being smaller than inner dimensions of a transportation space.

9. The rubber-wheel container crane according to claim 7, wherein the distances between the frame joints determine main dimensions of the subassemblies, the main dimensions being smaller than inner dimensions of a transportation space.

* * * * *